US005461286A

United States Patent [19]

Hirschmann

[11] Patent Number: 5,461,286

[45] Date of Patent: Oct. 24, 1995

[54] CIRCUIT ARRANGEMENT FOR OPERATING A LOW-PRESSURE DISCHARGE LAMP, TYPICALLY A FLUORESCENT LAMP, FROM A LOW-VOLTAGE SOURCE

[75] Inventor: Walter Hirschmann, Munich, Germany

[73] Assignee: Patent-Treuhand-Gesellschaft F. Elektrische Gluehlampen mbh, Munich, Germany

[21] Appl. No.: 332,857

[22] Filed: Nov. 1, 1994

[30] Foreign Application Priority Data

Nov. 25, 1993 [DE] Germany ..... 9318071 U

[51] Int. Cl.[6] ..... H05B 37/00

[52] U.S. Cl. ..... 315/205; 315/219; 315/209 R; 315/244; 315/241 P; 315/DIG. 5; 315/DIG. 7

[58] Field of Search ..... 315/219, 205, 315/209 R, 224, 244, 226, 291, 241 P, 200 R, 307, DIG. 5, DIG. 7, 276, 278, 254

[56] References Cited

U.S. PATENT DOCUMENTS

| | | | |
|---|---|---|---|
| 3,700,956 | 10/1972 | Cluet | 315/101 |
| 3,869,640 | 3/1975 | Kolomyjec | 315/DIG. 7 X |
| 4,071,807 | 1/1978 | Ichinose | 315/219 |
| 4,150,323 | 4/1979 | Yeh et al. | 315/209 R |
| 4,234,823 | 11/1980 | Charlot | 315/224 |
| 4,553,070 | 11/1985 | Sairanen et al. | 315/209 R |
| 4,710,682 | 12/1987 | Zuchtriegel | 315/224 |
| 4,959,591 | 9/1990 | Hirschmann | 315/209 R |
| 4,973,885 | 11/1990 | Kerwin | 315/219 |
| 5,237,243 | 8/1993 | Chung | 315/219 |

OTHER PUBLICATIONS

"Schaltnetzteile" (Switched–Mode Power Supplies) by W. Hirschmann/A. Hauenstein, published by Siemens AG, 1990 edition, pp. 45–46.

*Primary Examiner*—Benny Lee
*Assistant Examiner*—Haissa Philogene
*Attorney, Agent, or Firm*—Frishauf, Holtz, Goodman, Langer & Chick

[57] ABSTRACT

To operate a low-pressure discharge lamp, typically a fluorescent lamp, from a low voltage source of, for example, between 5 and 24 V, two diodes (D1, D2) polarized to provide for current passage towards the lamp are connected between the output of a blocking oscillator and the lamp (L). At least one diode (D2) provides for preheating the lamp electrode. The other diode (D1) prevents immediate starting of the lamp; it is integrated in the circuit between the secondary winding (N2) of the blocking oscillator transformer (TR) and one lamp electrode (E1). The first diode (D2) is connected between the primary winding (N1) and the other terminal of the secondary winding (N2), and also to the other lamp electrode (E2). An additional capacitor (C4) connected, effectively, across the lamp (L) improves the starting of the lamp. The circuit is readily adaptable for association with a recharging circuit (FIG. 3) for recharging a rechargeable battery to supply the lamp.

9 Claims, 2 Drawing Sheets

CIRCUIT ARRANGEMENT FOR OPERATING A LOW-PRESSURE DISCHARGE LAMP, TYPICALLY A FLUORESCENT LAMP, FROM A LOW-VOLTAGE SOURCE

Reference to related patent, the disclosure of which is hereby incorporated by reference: U.S. Pat. No. 4,973,885, Kerwin Reference to related literature disclosure: "Schaltnetzteile" ("Switched-Mode Power Supplies") by W. Hirschmann/A. Hauenstein, published by Siemens AG, 1990 edition, pages 45–46.

1. Field of the Invention

The present invention relates to a circuit to operate a low-pressure discharge lamp, for example a fluorescent lamp, from a low-voltage source, typically a battery, which may be a rechargeable battery, and having a voltage level of, for example, about 5 V, 12 V or 24 V. The fluorescent lamp itself could have a rated operating voltage of 110 V.

2. Background

Circuit arrangements to operate fluorescent lamps from direct voltage supplies, having a rated output voltage substantially less than the rated voltage of the lamp, are used in many commercially available battery-fed fluorescent lamps. These lamps are, for example, portable lamps operated from a battery integrated into the housing of the lamp, interior lights for motor vehicles, motor caravans, motor homes, live-in trailers, or the like. The circuit arrangements operate on the principle of half-wave blocking oscillators, also known as single-ended flyback converters. The supply voltage can be very low, a few volts, for example 5 V or less, and typically supplied from a battery in the same housing of the lamp, or from a vehicle battery, so that the voltage source may be the same as the vehicle voltage source, 6 V, 12 V, 24 V or the like. The blocking oscillator steps up the supply voltage to the starting voltage and, then, the operating voltage of the low-pressure discharge lamp after it has started or fired. A circuit arrangement based on this principle for operating a fluorescent lamp is described in U.S. Pat. No. 4,973,885, Kerwin, the disclosure of which is hereby incorporated by reference. The basic method of operation of such a blocking oscillator is also described in the book "Schaltnetzteile" ("Switched-Mode Power Supplies") by W. Hirschmann/A. Hauenstein, published by Siemens AG, 1990 edition, pages 45–46.

In the circuits well known in the prior art, a first secondary winding of the blocking oscillator transformer is connected to the base terminal of the oscillating transistor through a heatable lamp electrode. The primary winding of the transformer is connected to the collector circuit of the transistor. A second secondary winding is provided for the second lamp electrode.

It has been found that the high-frequency alternating current flowing through the heatable lamp electrode may not be sufficient to provide for complete electrode preheating. If the electrode is insufficiently preheated, that end of the lamp has the tendency to blacken and the lamp, then, will have reduced light output or reduced brightness after some operating time. The heating of the electrode filaments through a feedback winding causes changes in the operating current of the lamp, which leads to irregular operation or flicker.

THE INVENTION

It is an object to provide a circuit arrangement to operate a low-pressure discharge lamp, typically a fluorescent lamp, from a low-voltage source of a few volts, e.g. in the order of 5 V or more, which provides sufficient preheating of a heatable lamp electrode and permits a large number of ON/OFF switching operations of the lamp during the rated life of the fluorescent lamp.

Briefly, two diodes are provided in the circuit connected to the electrodes. The first one of these diodes is connected to a terminal of the secondary winding of the transformer generating the lamp starting voltage and, respectively, the lamp operating voltage, as well as to a first lamp electrode. The second diode is connected to the other terminal of the secondary winding as well as to the primary winding of the transformer and, with its other terminal, to the second heatable lamp electrode. The second diode ensures that, during the non-conducting phase of the blocking oscillator, the heatable lamp electrode continues to be heated by the primary winding of the transformer by direct current pulses; yet, premature starting of the lamp is prevented in that the secondary voltage is more highly attenuated at the beginning of the electrode heating phase, due to the inherently lower resistance of a cold, yet heatable filament than when the same filament is hot.

Preferably, a capacitor is connected between the unheated lamp electrode and the positive terminal of the voltage source or of the input capacitor, respectively, or connected across, that is, in parallel to the first diode. This capacitor ensures smoothing of direct current pulses and improves the operational behavior of the fluorescent lamp, in particular starting or ignition thereof. After the lamp has ignited, the heat power converted in the heatable electrode drops to a low value due to the high resistance of the heated filament. The circuit arrangement according to the present invention, thus, ensures starting of the lamp even at low temperatures.

DRAWINGS

DETAILED DESCRIPTION

Figure 1:
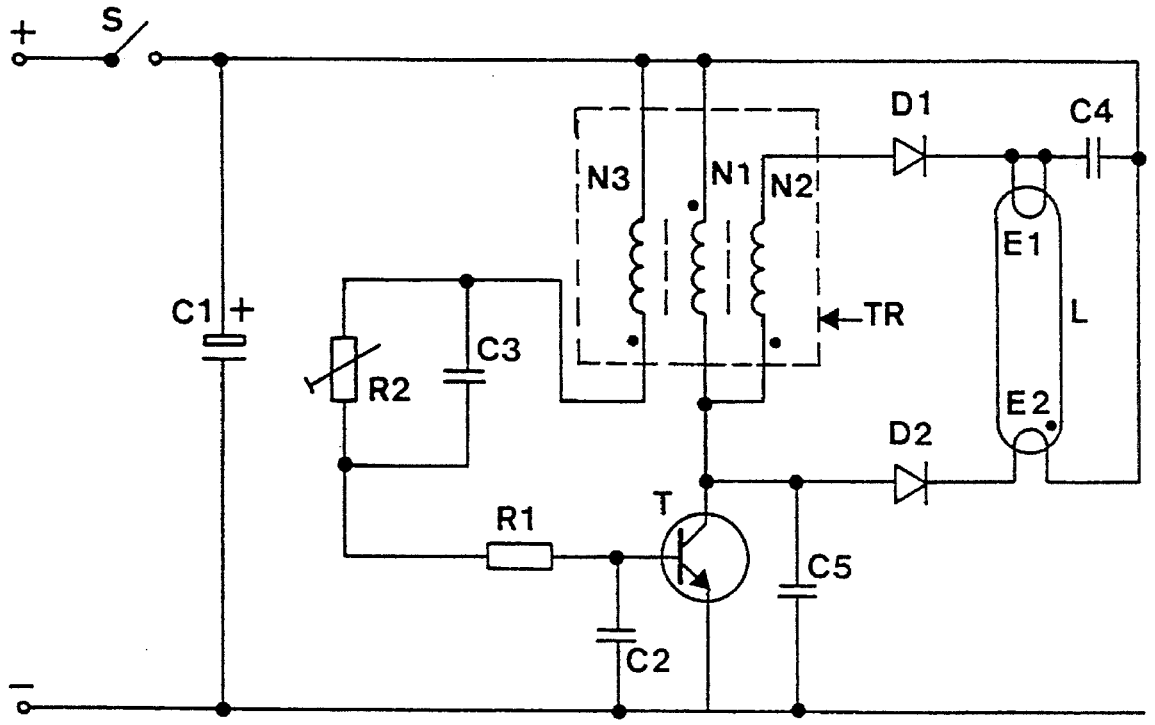
FIG. 1 shows a first exemplary embodiment of a circuit arrangement according to the invention for operating a low-pressure discharge lamp from a low voltage source.

Referring first to FIG. 1:

The circuit is intended to operate a portable lamp provided with a U-shaped fluorscent lamp, shown only schematically at L. It operates on the principle of a half-wave blocking oscillator, also known as a single-ended flyback converter, and contains, as a main component, a transistors T and a transformer TR with a primary winding N1 and two secondary windings N2, N3, all wound on a ferrite core. A primary battery or a rechargeable battery serves as the voltage source. Typical output voltage is 5 V. An electrolytic capacitor C1, having a comparatively high capacitance, is connected in parallel to the voltage source. The input capacitor C1 is charged to battery voltage and prevents the internal resistance of the battery voltage, which increases as the battery discharges, from undesirably affecting the operation of the lamp. Without the capacitor, the lamp's brightness drops too much with increasing discharge of the battery.

The positive terminal of the capacitor C1 and of the voltage source is connected to one terminal of the primary winding N1 and to one terminal of the secondary winding N3 of the transformer TR, as well as to the electrode E2 and the capacitor C4. The other terminal of the primary winding N1 is connected to the collector terminal of the switching transistor T. The emitter terminal of transistor T is connected to the negative terminal of the input capacitor C1 and the voltage source.

The base terminal of the transistor T is connected to the other end terminal of the secondary winding N3 of the transformer via a low-pass filter R1, C2, and a variable ohmic resistor R2. A capacitor C3 is connected in parallel with the variable resistor R2. The capacitor C2 is connected to the base-emitter junction of the transistor T. A capacitor C5 is connected in parallel with the collector-emitter junction of the transistor T. The capacitor C5 reduces the transient flyback voltage and hence the power loss which otherwise would occur. One end terminal of the secondary winding N2 of the transformer is also connected to the collector terminal of the transistor T and to the other terminal of the primary winding N1.

In accordance with a feature of the invention, the other terminal of the secondary winding N2 is connected to a diode D1 and then to the positive terminal of the voltage source via the short-circuited electrode filament E1 of the fluorescent lamp L and a smoothing capacitor C4. A second diode D2 is connected to the other terminal of the primary winding N1, and hence to the collector of transistor T, so that it is coupled through the primary winding to the positive terminal of the voltage source. The negative terminal of diode D2 is connected through the second electrode filament E2 of the lamp L, which is the heatable filament. In contrast to the first electrode filament El, the second electrode filament is not short-circuited and the heating current can therefore be passed through it. A switch S is provided, connected between the positive terminal of the voltage source and the positive terminal of the input capacitor C1 to switch the circuit, and hence the lamp L ON and OFF.

OPERATION

The circuit basically operates on the principle of a half-wave blocking oscillator. During the conducting phase of the transistor T, the transformer on the primary side stores energy which it provides to the lamp via the secondary winding N2 during the non-conducting phase. The switching transistor T is controlled by the second secondary winding N3, which is fed back to the primary winding N1. Both secondary windings N2, N3 are connected inversely with respect to the primary winding N1, as shown by the customary dot notation.

After the switch S moved to ON, current will flow through the feedback winding N3 of the transformer. This switches the transistor T ON and causes an increasing current through the primary winding N1 and, via the then conductive collector-emitter junction of the transistor T, that is, through its main current path. When this current has reached the maximum value of its flow through the primary winding N1, an inversely polarized voltage is induced in the feedback winding 3 to switch the transistor T OFF. After the decay of the induction process, the transistor T is switched ON again by the feedback between the primary winding N1 and the feedback winding N3, and a new operating cycle begins, as well known from blocking oscillator operation.

When the transistor T is switched OFF, an induced voltage is likewise provided in the first secondary winding N2 and produces the starting voltage and, later, the operating voltage required by the lamp.

In accordance with a feature of the invention, the first diode D1 and the low resistance of the still cold lamp electrode E2 prevents the lamp L from starting immediately. However, a heating current fed by the primary winding N1 flows also through the diode D2 and hence the electrode filament E2 of the lamp L. The ohmic resistance of the lamp electrode E2 increases as it is increasingly heated, as a result of which the voltage which is induced in the secondary winding N2 rises until the starting voltage across the lamp electrodes E1, E2 of approximately 700 V is reached. The electrode heating phase extends over a plurality of switching cycles of the transistor T and lasts for approximately 0.25 second. The transistor T has a switching frequency of more than 20 kHz.

After the lamp has started, only the clearly reduced operating voltage of approximately 110 V is applied thereto. Since the blocking oscillator supplies current to the lamp L only during the switched OFF phase of transistor T, the lamp would, theoretically, be operated only by interrupted unipolar direct current pulses. However, the diode D1 inherently has a certain recovery time which allows current to flow briefly also in the reverse direction, so that, actually, a high-frequency alternating current flows through the lamp L. A sufficiently high heating current flows through the second electrode element E2 of the lamp only during the switched OFF phase of the transistor T and only before starting of the lamp. The capacitor C4 smoothes the starting voltage and permits better starting of the fluorescent lamp.

In addition to the feedback winding N3 of the transformer, the base drive of the switching transistor T includes a variable ohmic resistor R2, with a capacitor C3 connected in parallel thereto, as well as a low-pass filter formed by the ohmic resistor R1 and capacitor C2. The low-pass filter filters high-frequency elements from the base input signal of the transistor T. The switching frequency of the transistor can be set to a desired value by suitable dimensioning of the base bias resistor R2 and the capacitor C3, which is connected in parallel with the resistor R2.

Table 1 is an example of suitable dimensions for the circuit components of the embodiment of FIG. 1, for a lamp L, operated at an electrical power of about 2.5 W and supplied from a 5 V voltage source. Switching frequency of the transistor T is approximately 55 kHz.

EMBODIMENT OF FIG. 2

The embodiment differs from the first embodiment only in that the capacitor C4' is used instead of the capacitor C4. Capacitor C4' is connected across the first diode D1, rather than to the positive supply terminal. All other details, and the method of operation, are identical to the first embodiment of FIG. 1.

EMBODIMENT OF FIG. 3

Figure 3:
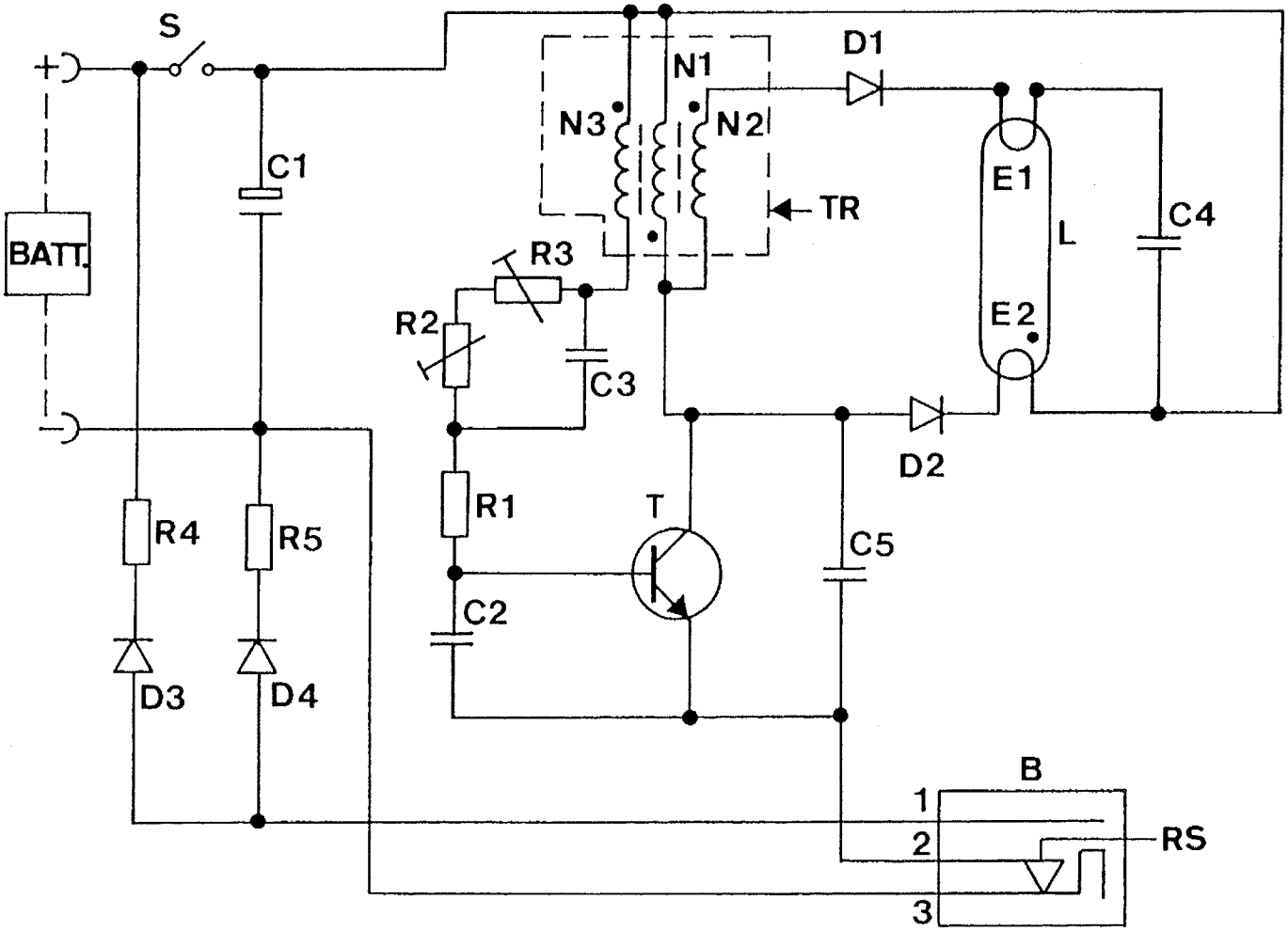
FIG. 3 shows a third embodiment of the circuit combined with a charging circuit for a rechargeable battery to operate a lamp-battery combination.

This circuit arrangement corresponds essentially to that of the first embodiment of FIG. 1, and identical components in FIG. 3 have been given the same reference numerals and letters as in FIG. 1.

In addition to the circuit of FIG. 1, the circuit of FIG. 3 also contains a continuously variable dimmer resistor. Additionally, the circuit illustrates the combination of the lamp and the lamp circuit with a charging circuit shown as a charging plug which makes it possible to recharge a rechargeable battery BATT, if such a battery is used as the energy supply. The duty cycle of the switching transistor T and the electrical power fed to the lamp can be controlled with the aid of the dimmer resistor.

The circuit according to the third embodiment contains, as main components, again the transistor T, the transformer TR with its primary and secondary windings N1, N2, N3 and its ferrite core. The voltage source is formed by four NiCad (nickel-cadmium) rechargeable cells. The supply voltage of such cells is approximately 5 V. The electrolytic capacitor C1 operates as described before.

In accordance with the embodiment of FIG. 3, the base terminal of the transistor T is connected to the other end of the secondary winding N3 of the transformer TR through the resistor R1 as well through the ohmic resistor R2. In addition, however, a variable dimmer resistor is serially connected to resistor R2. Resistor R2 is shown as a variable resistor, the resistance value of which can usually be set at the factory supplying the circuit. Resistor R3 can be controlled by the user. The capacitor C3 is connected across both resistors R2, R3. The low-pass capacitor C2 is connected, as before, in parallel to the base-emitter junction of the transistor T. Resistor R3 provides a minimum resistance for the resistor combination of resistor R2 and dimmer resistor R3, connected across capacitor C3.

Capacitor C5, as before, is connected across the main current path, that is, the collector and emitter terminals of the transistor T, to reduce transient voltage and power loss which occurs as a result thereof. In all other respects, the blocking oscillator circuit, including the diodes D1, D2 and capacitor C4, is identical to that described in connection with FIG. 1.

In addition to the foregoing, the circuit arrangement contains a charging plug B which allows the rechargeable battery BATT to be recharged. The terminal 1 of the charging plug B is connected to the positive terminal of the voltage source via a diode D3 and an ohmic resistor R4. Terminal 1 is also connected to the negative terminal of the input capacitor C1 via a light emitting diode D4 and via an ohmic resistor R5. Terminal 2 of the charging plug B is connected to the emitter terminal of the transistor T, while the terminal 3 of the charging plug B is connected to a negative terminal of the voltage source and to the negative terminal of input capacitor C1.

During operation of the lamp, terminals 2 and 3 of the charging plug B are electrically connected by a releasable switch RS, so that the emitter of the transistor T is connected to the negative terminal of the voltage source, operating therefore identically to the embodiment of FIG. 1. During charging operation, the switch RS opens. The light emitting diode D4 lights and no energy is supplied to the lamp L even if the switch S is closed. During recharging of the rechargeable battery, the electrically conductive connection between the terminals 2 and 3 of the charging plug B is interrupted by the then open switch RS, as is the connection between the emitter of the switching transistor T and the negative terminal of the voltage source. The circuit operates basically on the same principle as that of the first embodiment.

Figure 2:
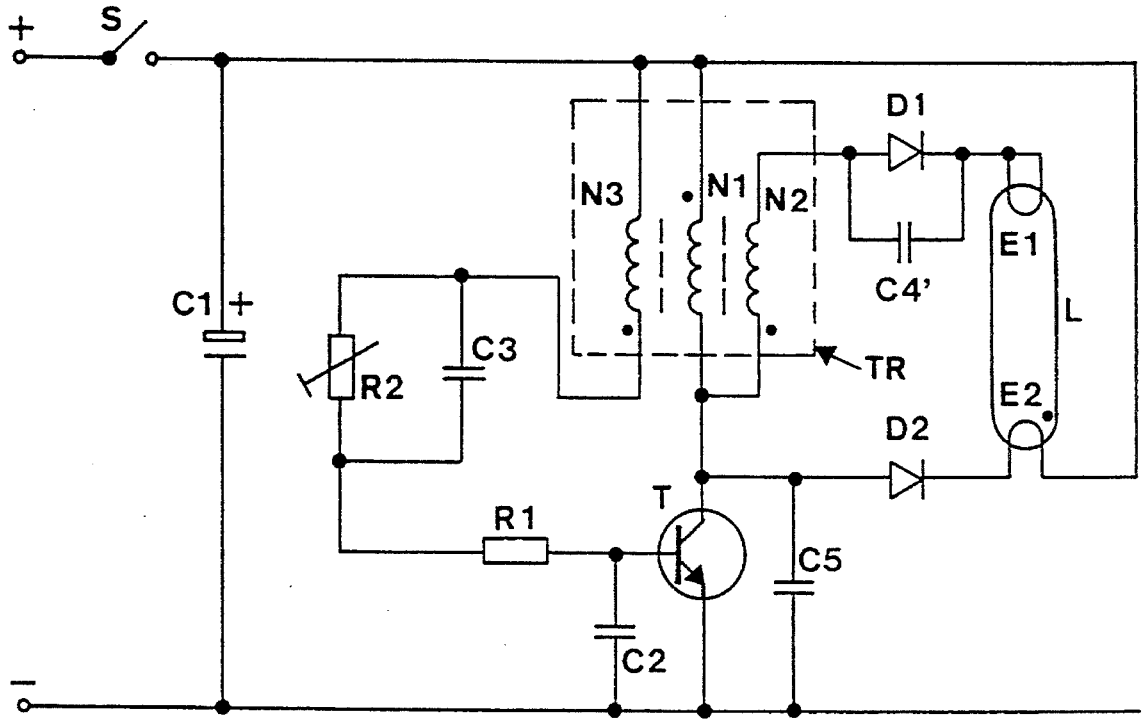
FIG. 2 shows a second exemplary embodiment of the circuit arrangement to operate a small fluorescent lamp.

FIG. 3 illustrates another modification which could be applied equally to the circuits of FIGS. 1 and 2. The filament E1 of the lamp L is not short-circuited, so that some heating current can flow through the diode D1, obtained from the first secondary winding N2. The current flow is controlled similarly to current flow through the electrode E2.

Suitable dimensions of components used in the embodiment of FIG. 3 are reproduced in Table 2.

Various changes and modifications may be made, and any features described herein may be used with any of the others, within the scope of the inventive concept. For example, the heating current to both lamp electrodes can be connected as shown in FIG. 3 in all the embodiments, to apply heating current to both electrodes by eliminating the short circuit of the first lamp electrode E1, as shown in FIG. 3.

TABLE 1

| | |
|---|---|
| Ferrite transformer TR | EF16 |
| N1, N3 | 25 turns |
| N2 | 420 turns |
| R1 | 47 Ω |
| R2 | 1 kΩ |
| C1 | 100 μF |
| C2, C5 | 10 nF |
| C3 | 22 nF |
| C4, C4' | 100 pF, 1 kV |
| T | D882-Y |
| D1, D2 | 1N1937 |

TABLE 2

| | |
|---|---|
| Ferrite transformer TR | EF16 |
| N1, N3 | 25 turns |
| N2 | 420 turns |
| R1 | 47 Ω |
| R2 | 560 Ω |
| R3 | 1 kΩ |
| R4 | 47 Ω; 0.8 W |
| R5 | 470 Ω |
| C1 | 100 μF; 10 V |
| C2, C5 | 10 nF |
| C3 | 22 nF |
| C4 | 150 pF; 1 kV |
| T | D882-Y |
| D1, D2 | 1N1937 |
| D3 | 1N4001 |
| D4 | LED, red |

I claim:

1. A low-pressure discharge lamp operating circuit, for operation of the discharge lamp (L) from a low voltage source having a blocking oscillator circuit including a switching transistor (T) and an oscillating transformer (TR) having a primary winding (N1) and two secondary windings (N2, N3), wherein the primary winding (N1) of the transformer (TR) is serially connected to the main switching path of the switching transistor (T);

a first one (N2) of the secondary windings providing ignition and operating energy, respectively, to the lamp (L), and a second one (N3) of the secondary windings forming, and being connected as, a feedback winding to the control electrode of the transistor (T), and further comprising, in accordance with the invention, a first diode (D1) coupled between a first terminal of the first secondary winding (N2) and one electrode (E1) of the lamp; and a second diode (D2) coupled between a second electrode (E2) of the lamp and a second terminal of the first secondary winding (N2) as well as to one of the terminals of the primary winding (N1) of the transformer (TR).

2. The circuit of claim 1, further including a capacitor (C4) connected across the electrodes (E1, E2) of the lamp (L).

3. The circuit of claim 1, further including a capacitor (C4') connected across one (D1) of said first and second diodes (D1, D2).

4. The circuit of claim 1, further including a variable dimmer resistor (R3) connected in a feedback circuit including the second one (N3) of the secondary winding and a control terminal of said transistor (T).

5. The circuit of claim 4, wherein said dimmer resistor (R3) is serially connected between the feedback winding (N3) and at least one further resistor (R1, R2) to the control electrode of the transistor (T).

6. The circuit of claim 1, further including a variable dimmer resistor (R3) connected to the blocking oscillator circuit to control the duty cycle thereof.

7. The circuit of claim 1, for combination with a low voltage energy supply formed by a rechargeable battery (BATT); and a recharging plug (B) connected to said operating circuit to permit recharging of the battery from an external energy supply.

8. The circuit of claim 1, wherein said lamp (L) has two heatable electrodes (E1, E2); and wherein one (E1) of said heatable electrodes, connected to one (D1) of said diodes is short-circuited.

9. The circuit of claim 1, wherein said lamp (L) has two heatable electrodes (E1, E2); and wherein both of said heatable electrodes are supplied with heating current therethrough.

* * * * *